US009480299B2

(12) United States Patent
Dinndorf et al.

(10) Patent No.: US 9,480,299 B2
(45) Date of Patent: Nov. 1, 2016

(54) SLIP-ON FOOTWEAR WITH FOOT SECURING SYSTEM

(71) Applicant: Red Wing Shoe Company, Inc., Red Wing, MN (US)

(72) Inventors: Mark T. Dinndorf, Edina, MN (US); Charles L. Caverly, Red Wing, MN (US); Roy Smith, Ellsworth, WI (US); Russell Lane Davis, Wynne, AR (US)

(73) Assignee: Red Wing Shoe Company, Inc., Red Wing, MN (US)

( * ) Notice: Subject to any disclaimer, the term of this patent is extended or adjusted under 35 U.S.C. 154(b) by 252 days.

(21) Appl. No.: 14/205,038

(22) Filed: Mar. 11, 2014

(65) Prior Publication Data

US 2014/0259783 A1 Sep. 18, 2014

Related U.S. Application Data

(60) Provisional application No. 61/781,707, filed on Mar. 14, 2013.

(51) Int. Cl.

| | |
|---|---|
| ***A43C 11/00*** | (2006.01) |
| ***A43B 7/14*** | (2006.01) |
| ***A43B 23/02*** | (2006.01) |
| ***A43B 23/22*** | (2006.01) |
| ***A43C 11/16*** | (2006.01) |

(52) U.S. Cl.

CPC ..... *A43B 7/1495* (2013.01); *A43B 23/0275* (2013.01); *A43B 23/22* (2013.01); *A43C 11/00* (2013.01); *A43C 11/16* (2013.01); *A43C 11/165* (2013.01)

(58) Field of Classification Search

CPC ..... A43B 7/14; A43B 23/08; A43C 11/00
USPC ..... 36/50.1, 50.5, 88, 92, 93
See application file for complete search history.

(56) References Cited

U.S. PATENT DOCUMENTS

| | | | | |
|---|---|---|---|---|
| 4,802,291 | A * | 2/1989 | Sartor | A43B 5/0449 36/118.1 |
| 4,811,503 | A * | 3/1989 | Iwama | A43B 5/0449 36/118.1 |
| 5,381,609 | A * | 1/1995 | Hieblinger | A43C 11/165 36/50.1 |
| 6,378,230 | B1 * | 4/2002 | Rotem | A43C 11/16 36/118.1 |
| 7,065,906 | B2 * | 6/2006 | Jones | A43C 11/008 36/50.1 |
| 7,757,412 | B2 * | 7/2010 | Farys | A43B 5/0439 36/50.1 |
| 7,818,899 | B2 * | 10/2010 | Dinndorf | A43B 3/0031 36/4 |
| 7,963,049 | B2 * | 6/2011 | Messmer | A43B 5/0401 36/117.6 |
| 8,375,603 | B2 * | 2/2013 | Dinndorf | A43B 3/0031 36/4 |
| 8,782,927 | B2 * | 7/2014 | Dinndorf | A43B 3/0031 36/117.6 |
| 2001/0025437 | A1 * | 10/2001 | Rork | A43B 23/28 36/88 |
| 2006/0191164 | A1 * | 8/2006 | Dinndorf | A43B 3/0031 36/50.1 |
| 2006/0201031 | A1 * | 9/2006 | Jones | A43C 11/008 36/50.1 |
| 2007/0186447 | A1 * | 8/2007 | Ramos | A43C 1/04 36/50.1 |
| 2008/0086911 | A1 * | 4/2008 | Labbe | A43B 11/00 36/50.1 |
| 2009/0199435 | A1 * | 8/2009 | Robinson, Jr. | A43C 1/06 36/108 |

(Continued)

*Primary Examiner* — Marie Bays
(74) *Attorney, Agent, or Firm* — Merchant & Gould P.C.

(57) ABSTRACT

The present disclosure provides footwear construction that includes a foot securing mechanism that provides improved fit without resulting in footwear that is substantially more difficult or time consuming to put on and take off. In one embodiment the footwear is a slip-on boot having both an instep hold down system and a heel retaining system. In the depicted embodiment both systems can be activated by a single mechanism exposed on the outside of the boot. Related methods and additional embodiment are also provided.

18 Claims, 12 Drawing Sheets

(56) References Cited

U.S. PATENT DOCUMENTS

2010/0319216 A1* 12/2010 Grenzke ..... A43C 1/00 36/54

2011/0197471 A1* 8/2011 Dinndorf ..... A43B 3/0031 36/50.1

2015/0059206 A1* 3/2015 Lovett ..... A43C 11/165 36/50.1

* cited by examiner

SLIP-ON FOOTWEAR WITH FOOT SECURING SYSTEM

RELATED APPLICATION

This application claims priority to U.S. Provisional Application Ser. No. 61/781,707 filed on Mar. 14, 2013, which application is incorporated herein by reference in its entirety.

TECHNICAL FIELD

The present disclosure relates to footwear. More particularly, the disclosure relates to footwear with flexible soles for configured for walking, hiking, running that include mechanisms other than, or in addition to, laces, buckles and zippers to secure a person's foot within the footwear.

BACKGROUND

Footwear typically includes a sole and an upper. The sole protects the person's foot from contact with the ground and provides traction. The sole is commonly constructed of rubber and/or another material that provides traction and foot protection. The upper connects the sole to the person's foot and is commonly constructed of leather and/or fabric. A common upper configuration includes an external lacing structure that in a released state allows for easy foot entry and exit from the footwear, and in a tightened state secures a person's foot within the footwear.

Some types of footwear do not rely on external securing structures to secure the footwear onto the person's foot. These types of footwear can be held onto the person's foot based in part on the material used to construct the footwear and/or in part on the geometry of the footwear (e.g., traditional cowboy boots, classic pull on motorcycle boots, other slip-on style boots). This type of footwear can include some buckles and laces, but generally such external securing structures are auxiliary. This type of footwear has advantages. For example, this type of footwear is generally relatively quick to put on and take off, more sealed from the elements, less likely to snag, etc.). The present disclosure relates to features that are particularly applicable to the above described type of footwear, but could also be integrated into traditional laced up footwear.

SUMMARY

The present disclosure provides footwear construction that includes a foot securing mechanism that provides improved fit without resulting in footwear that is substantially more difficult or time consuming to put on and take off. In one embodiment the footwear is a slip-on boot having both an instep hold down system and a heel retaining system. In the depicted embodiment both systems can be activated by a single mechanism exposed on the outside of the boot. Related methods and additional embodiment are also provided.

DETAILED DESCRIPTION

Figure 1:
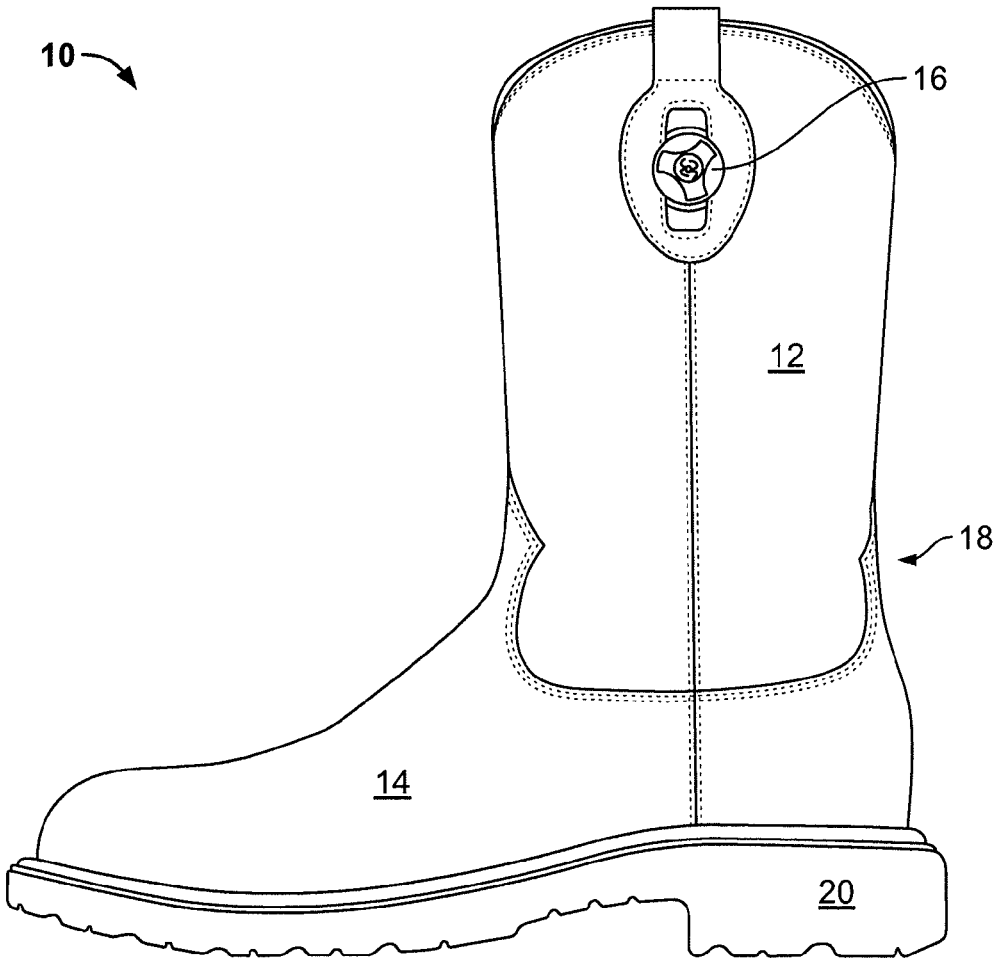
FIG. 1 is a first side view of footwear according to an embodiment of the present disclosure.
Figure 2:
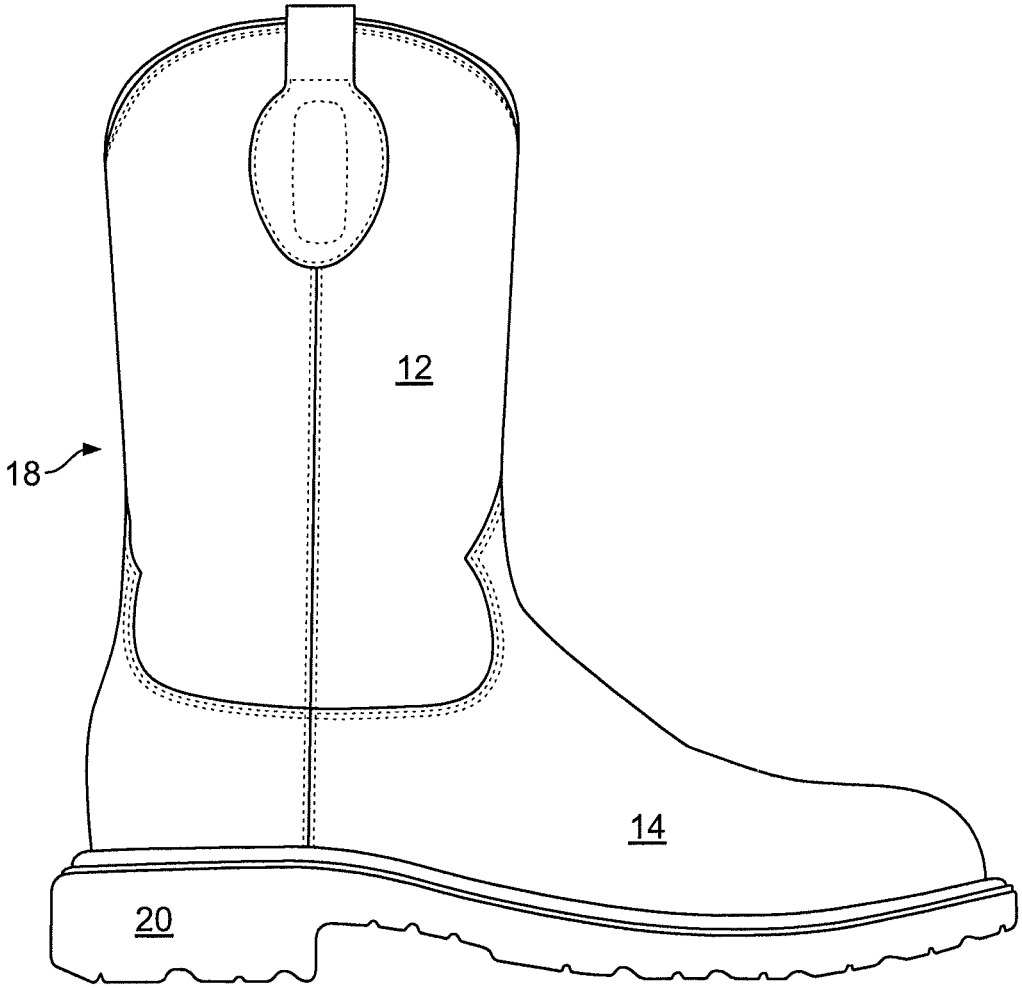
FIG. 2 is a second side view of the boot of FIG. 1.
Figure 3:
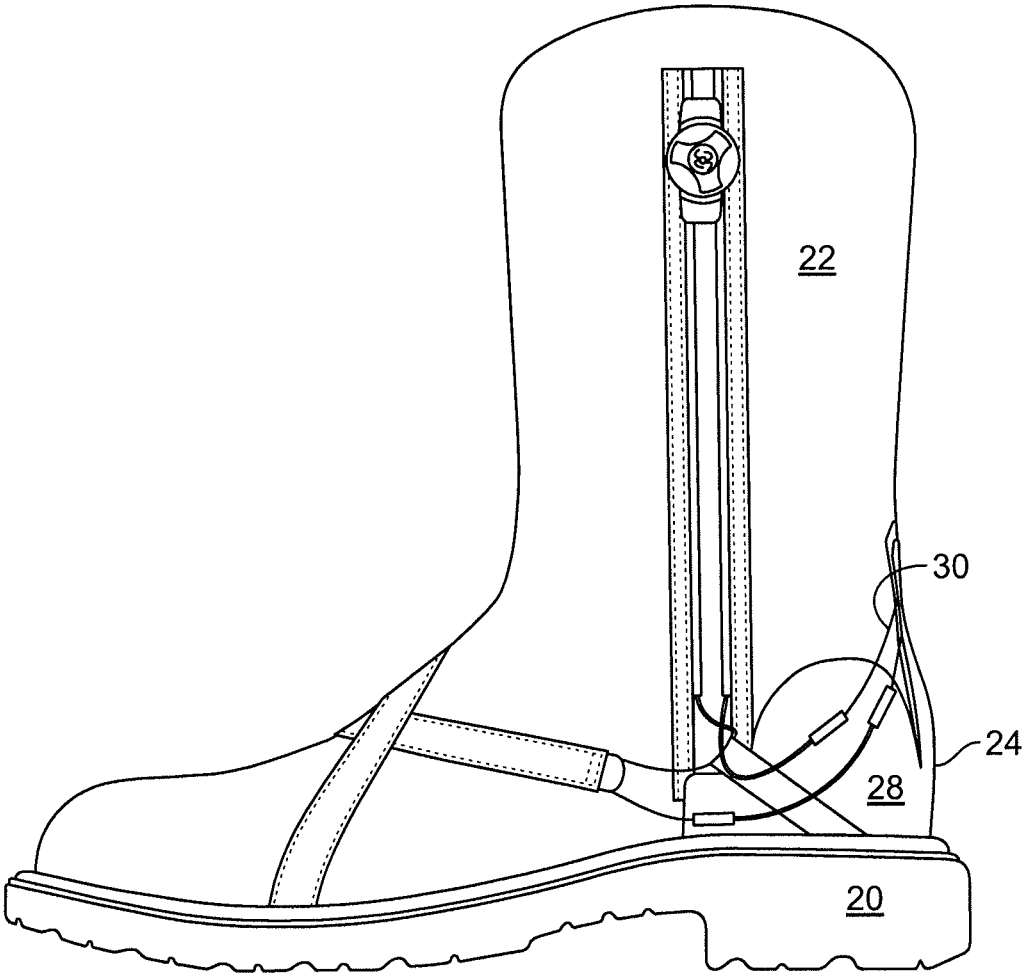
FIG. 3 is a first side view of the boot of FIG. 1 with the external covering material removed.
Figure 4:
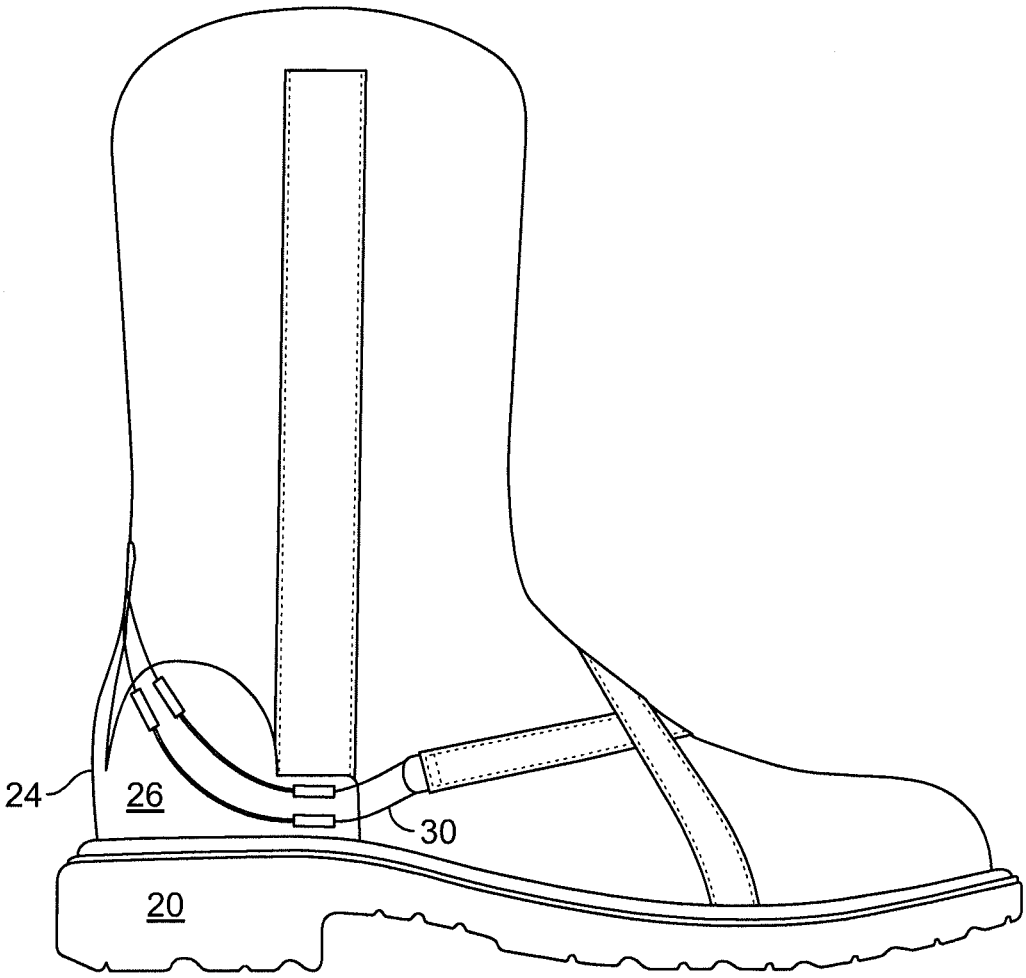
FIG. 4 is a second side view of the boot of FIG. 1 with the external covering material removed.
Figure 5:
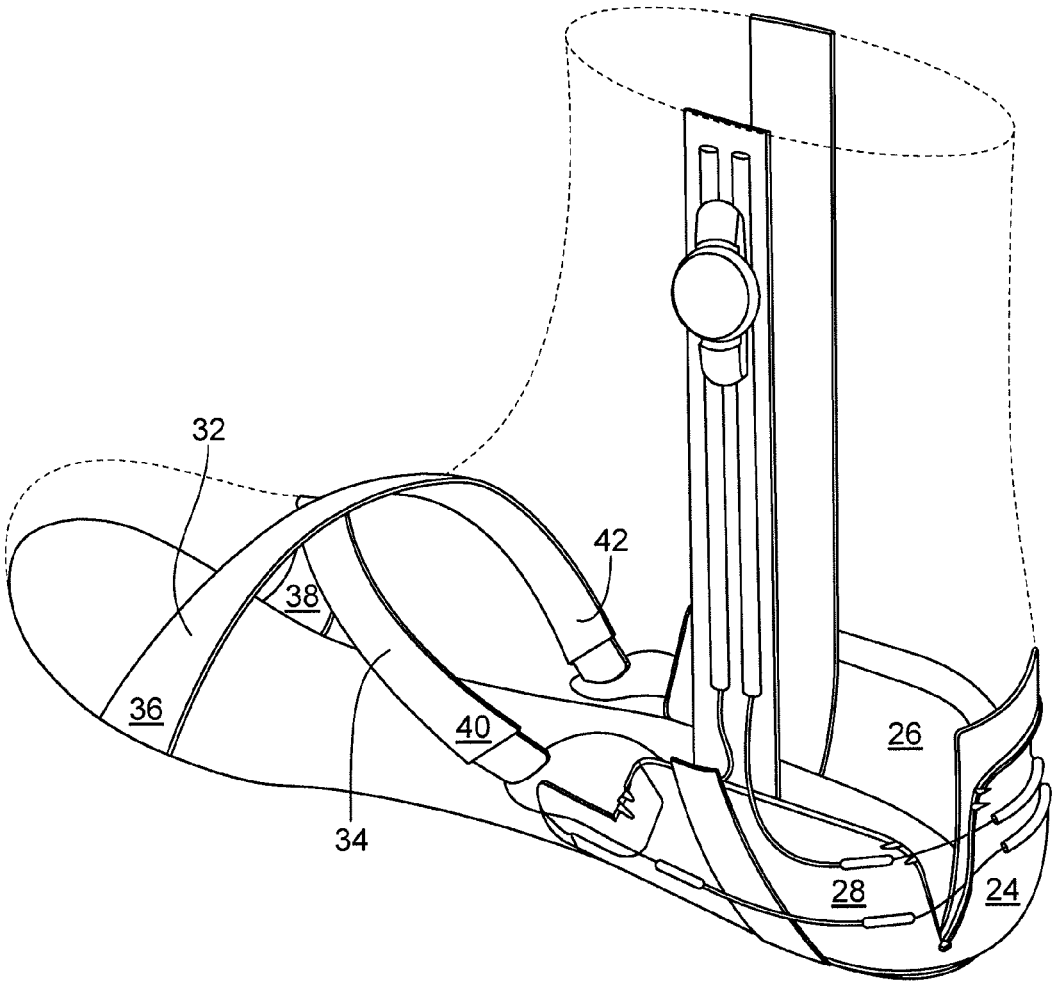
FIG. 5 is an isometric view of the boot of FIG. 1 with the external covering material removed and the liner removed.
Figure 6:
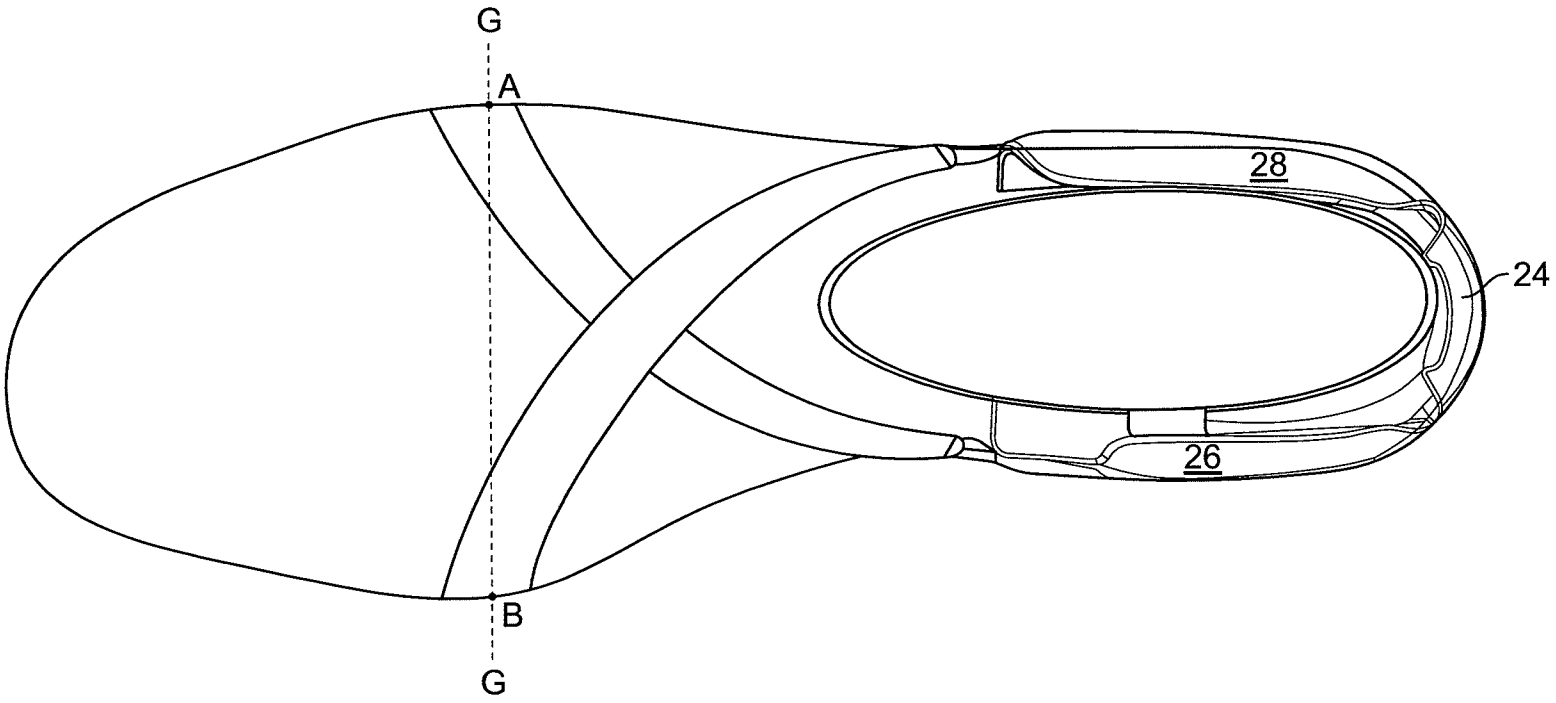
FIG. 6 is a top view of FIG. 5.
Figure 7:
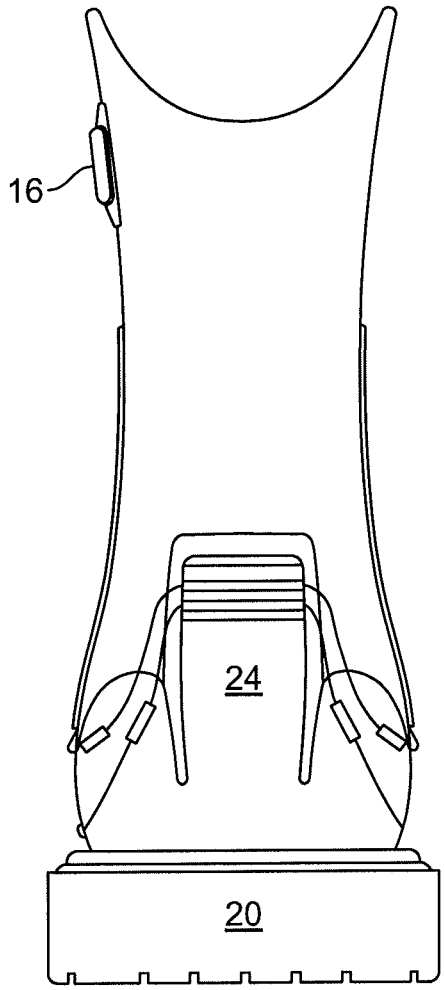
FIG. 7 is a rear view of FIG. 1 with the external covering material removed.
Figure 8:
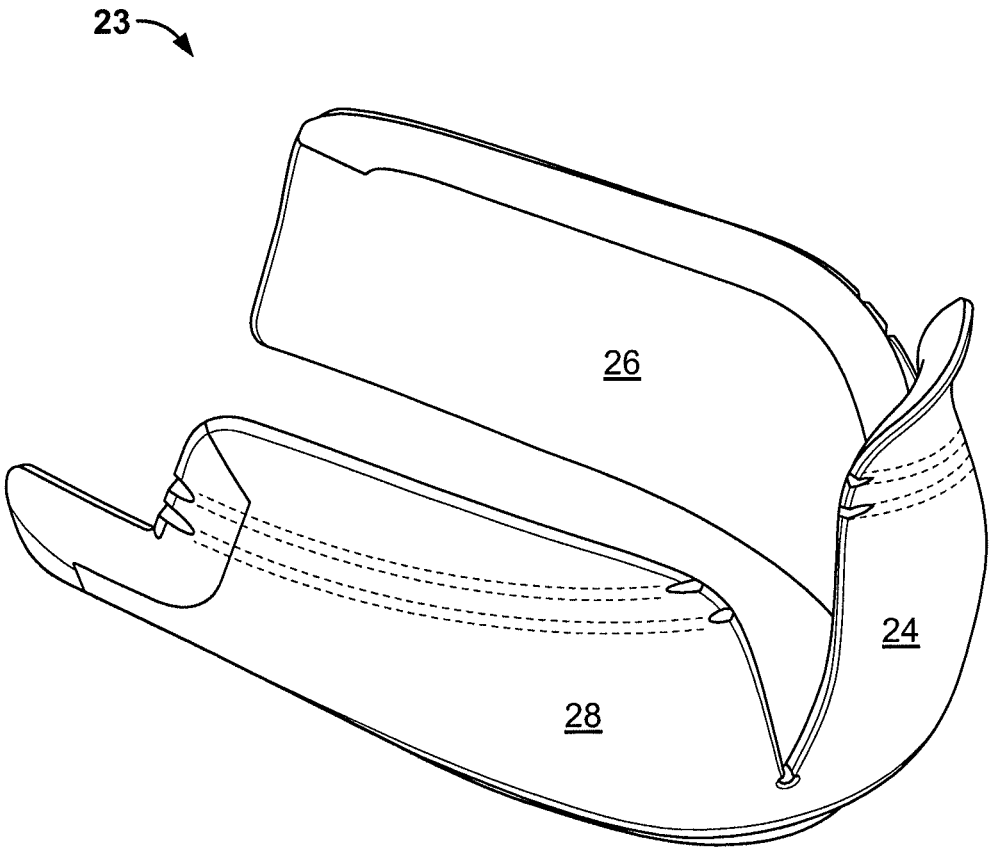
FIG. 8 is an isometric view of a heel counter component of the boot of FIG. 1.
Figure 9:
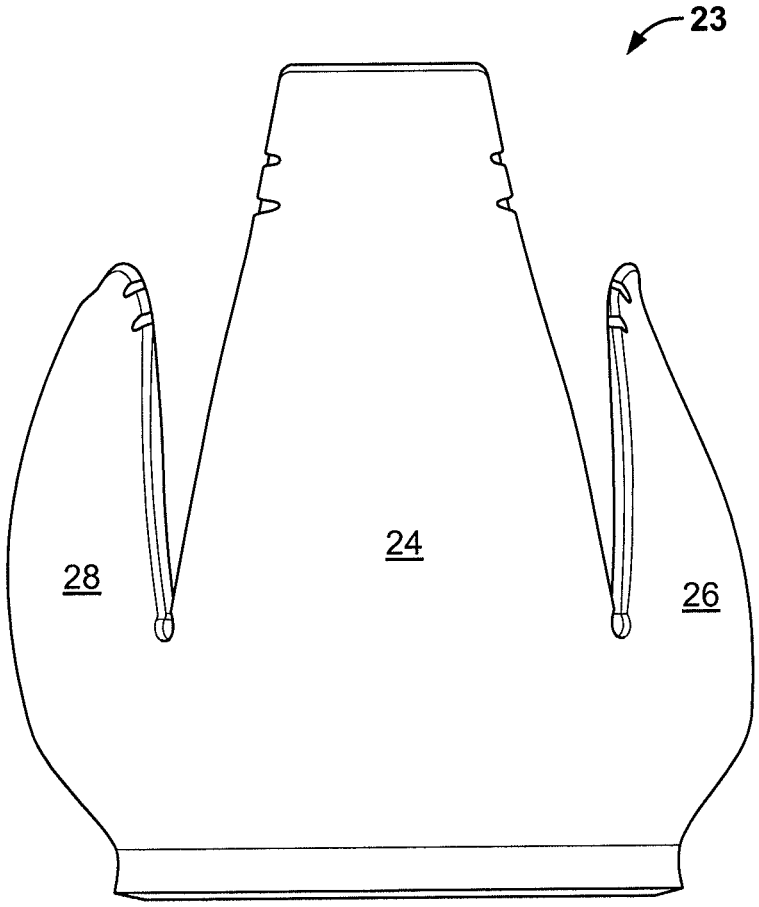
FIG. 9 is rear end view of FIG. 8.

Referring to FIGS. 1-9 an example embodiment of the present disclosure is shown. In the depicted embodiment the footwear is a slip-on boot variety. It should be appreciated that many other embodiments are also possible. For example, the features of the present disclosure can be integrated into hiking boots, trail running shoes, cold weather pack boots, and many other types of footwear including those with or without laces or other external traditional footwear closure/securing mechanisms.

In the depicted embodiment, the boot 10 is configured such that the user slides his or her foot into the boot through an upwardly extending neck portion 12 of the boot 10 (also referred to herein as a lower leg receiving portion of the boot) into the lower foot receiving portion the boot 14. Once the user's foot is inserted, the user further secures his or her foot in the boot 10 by rotating the dial 16 of a cable take up/release mechanism that is exposed on the exterior of the boot 10. In the depicted embodiment, rotation of the dial 16 simultaneously applies an inward and downward force against the user's heel and applies a rearward and downward force across the user's instep. It should be appreciated that in alternative embodiment the cable take up/release mechanism may or may not include a rotating dial.

In the depicted embodiment the neck portion 12 and the foot receiving portion 14 cooperatively comprise the upper 18 of the boot 10, which is connected to an sole assembly 20. The upper 18 has a soft construction and is configured to cover the foot and lower leg of the user and hold the sole assembly 20 (e.g., outsole, midsole, and foot bed) in place against the bottom of the user's foot during normal use. The upper 18 in the depicted embodiment has a multilayer construction having an exterior layer constructed primarily of leather and an inner lining 22 constructed primarily of fabric. It should be appreciated that although the features of the present disclosure is shown integrated into a slip-on boot configuration with a loose fitting upper that is devoid of laces, buckles, or zippers the features of the present disclosure could alternatively be integrated into footwear having many different upper constructions including uppers having other soft constructions that are less or more stiff (e.g., including very stiff construction such as the construction of traditional alpine ski boots that have a hard plastic outer shell), more or less layers (single layer or multilayer), and having additional external/internal foot and lower leg securing systems (laces, buckles, ratchets, and zippers).

In the depicted embodiment the sole assembly 20 of the boot 10 has a flexible construction as the boot is configured for waking/hiking. As the user walks in the boot 10, the sole flexes under the ball of the user's foot. In the depicted embodiment the sole has a rubber ground facing surface that provides traction. As discussed above, it should be appreciated that the features of the present disclosure can be integrated into footwear having many different sole assembly constructions including soles with leather construction such as those used in cowboy style boots, softer soles such as those soles commonly used in running shoes, and stiff soles such as those used in alpine ski boots or climbing boots.

In the depicted embodiment the boot 10 includes a foot securing system that includes both a heel retaining system and an instep hold down system. In the depicted embodiment the heel retaining system and the instep hold down system are integrated. The two systems in the depicted embodiment share components (e.g., single cable 30) and can be activated and deactivated simultaneously. In the depicted embodiment the forces applied by the heel retaining system and the instep hold down system are dependent. The depicted embodiment is configured to balance forces so that excessive force cannot be applied to the instep hold down system while little or no force is applied to the heel retaining system. It should be appreciated that many alternative embodiments of the foot securing systems are possible, including ones that include only a heel retaining system or only an instep hold down system, as well as systems that include a heel retaining system and an instep hold down system that are operated independent of each other wherein force can be applied to one system without having an effect on the other system, and system wherein the heel retaining systems and instep system are independent and do not have components in common (e.g., the dial).

In the depicted embodiment the heel retaining system of the foot securing system is configured to selectively apply force inwardly and downwardly against the user's heel. The heel retaining system of the depicted embodiment includes a heel counter 23 which includes a rear portion 24, a first side portion 26, and a second side portion 28. The heel retaining system of the depicted embodiment is configured to simultaneously moves the first side portion 26 (inside portion) of the heel counter 23 towards the second side portion 28 (outside portion) of the heel counter 23, moves the outside side portion of the heel counter 28 towards the inside side portion 26 of the heel counter, and moves the rear portion 24 of the heel counter in a forward direction. In the depicted embodiment a single tensioning cable 30 engages the side portions 26, 28 and rear portion 24 of the heel counter 23. It should be appreciated that many other configurations are possible. For example, in an alternative embodiment only the rear portion of the heel retaining system may be moved forwarded or only a single side portion may be moved inwardly.

In the depicted embodiment the first and second side portions 26, 28 and rear portion 24 each include upper and lower portions. The upper portions of the first and second side portions 26, 28 and rear portion 24 are separated to facilitate independent relative movement therebetween, and the lower portions of the first and second side portions 26, 28 and rear portion 24 are joined to provide structural support and rigidity. See, for example, FIGS. 8 and 9. In the depicted embodiment the heel counter 23 is integral in that it is constructed as a single piece rather than separate pieces connected to each other (e.g., the heel counter can be molded as a single part). It should be appreciated that many other alternative heel cup configurations are possible including, for example, configurations wherein the upper portions of the first and second side portions 26, 28 and rear portion 24 are not separated, or where the separation defines two rather than three portions.

In the depicted embodiment the top portions of the first and second side portions 26, 28 and rear portion 24 act as springs that cause the heel cup to automatically return to an open position to facilitate receiving the user's heel. In the depicted embodiment the tensioning cable 30 is routed along the top portions of the first and second side portions 26, 28 and rear portion 24 such that when the cable is tensioned (e.g., drawn into the reel via rotation of the dial 16), the cable applies an inward and downwardly directed force on the heel cup causing the heel counter 23 to constrict and apply an inwardly and downwardly directed force on the user's heel. It should be appreciated that many alternative configurations exist. For example in an alternative configuration the forces may be direct inwardly, but not downwardly or only forwardly and not inwardly or not downwardly.

The instep hold down system of the foot securing system of the depicted embodiment is configured to exert a downward and rearward force on the user's instep. In the depicted embodiment, the instep hold down system includes a first foot hold down strap 32 and a second hold down strap 34. Each of the first and second hold down straps 32, 34 include first ends 36, 38 anchored near (e.g., along/overlapping/adjacent) the ball girth GG of the forefoot portion of the foot receiving portion adjacent the flexible sole. It should be appreciated that the ball girth is the circumferential length measured around the ball width line, which is the width measured from the first metatarsal joint to the fifth metatarsal joint. In particular, in the depicted embodiment the first and second hold down straps are anchored at points A and B of FIG. 6. Points A and B are the points of inflection on the upper and lower curve that defines the boarder of the foot bed in the forefoot portion of the footwear.

In the depicted embodiment, the first and second straps 32, 34 overlap and are free to move relative to each other. Each of the first and second hold down straps 32, 34 includes second ends 40, 42 that include pass through cable routing mechanisms. In the depicted embodiment the cable 30 is slidably engaged with the pass through cable routing mechanisms such that the straps 32, 34 are pulled downwards and rearward when the cable is tensioned. In the depicted embodiment the cable 30 does not terminate at the second ends of either of the straps 32, 34 and instead loops back and the cable routing mechanisms function as pulleys. In the depicted embodiment straps 32, 34 are configured such that the point at which they overlap moves based on the user's foot characteristics, but is generally located below the short heel point of the footwear. In the depicted embodiment, the second ends 40, 42 are located such that applying tension thereto does not drive the cable routing mechanism into the user's foot. In the depicted embodiment the second ends are low (e.g., 0.5-4.0 centimeters from the sole) and substantially vertical (60-120 degrees). In the depicted embodiment the straps are constrained only at their ends. Straps are free to float and adjust to the user's foot shape. However, it should be appreciated that alternatively the straps could also be constrained along their lengths as well (e.g., housed within guide sleeves or loops).

In the depicted embodiment the cable 30 that applies tension to the first and second straps 32, 34 is the same single cable that causes the heel cup to constrict and that is taken up by rotating the dial 16 of the rotating mechanism. This configuration provides simultaneous engagement of the instep hold down system and the heel retaining system. The configuration also provides load balancing between the systems and among the components of each system. In the depicted embodiment, the system is configured such that an appropriate amount of tension will be applied to the instep hold down and the heel counter. For example, when the user has a large forefoot or high instep and a narrow heel, the system of the depicted embodiment is configured such that it will avoid excessively bearing down on the instep while not sufficiently grabbing the heel. Once the straps 32, 34 press against the user's foot, further tension on the cable will result in pressure from the heel counter 23 against the user's heel. Conversely, if the user has a large heel and a narrow forefoot or low instep, the system of the depicted embodiment is configured such that it will avoid excessively bearing down on the heel without providing sufficient hold down on the instep. Once the heel counter 23 applies force against the user's heel, further pressure will cause the straps to press against the user's instep.

In the depicted embodiment the foot securing system is primarily internal to the footwear. In the depicted embodiment the first and second straps 32, 34, the cable 30, and the heel counter 23 are positioned between the outer covering (leather outer shell) and the inner liner 22. In the depicted embodiment the foot securing system engages and constricts the liner 22 without substantially changing the shape of the outer covering. In the depicted embodiment, the loose fitting outer covering appears to and does remain loose fitting. In addition, in the depicted embodiment a substantial portion of the upper neck portion 12 of the upper 18 (including the liner 22 and the outer cover material) remains loose fitting even when the foot securing system is engaged because the instep hold down system and the heel retaining system are primarily located in the foot receiving portion 14 of the upper 18. In the depicted embodiment the short heel girth of a United States size nine boot (e.g., boot having internal length of 9.75-10.0 inches) is between 13.0 to 17.0 inches (e.g., between 14.5-15.0 inches). The upper peripheral edge of the boot is between 12.5 to 15.5 inches (e.g., between 13.5-14.5 inches). It should be appreciated that many other alternative configurations are also possible and that these dimension are illustrative only.

Figure 10:
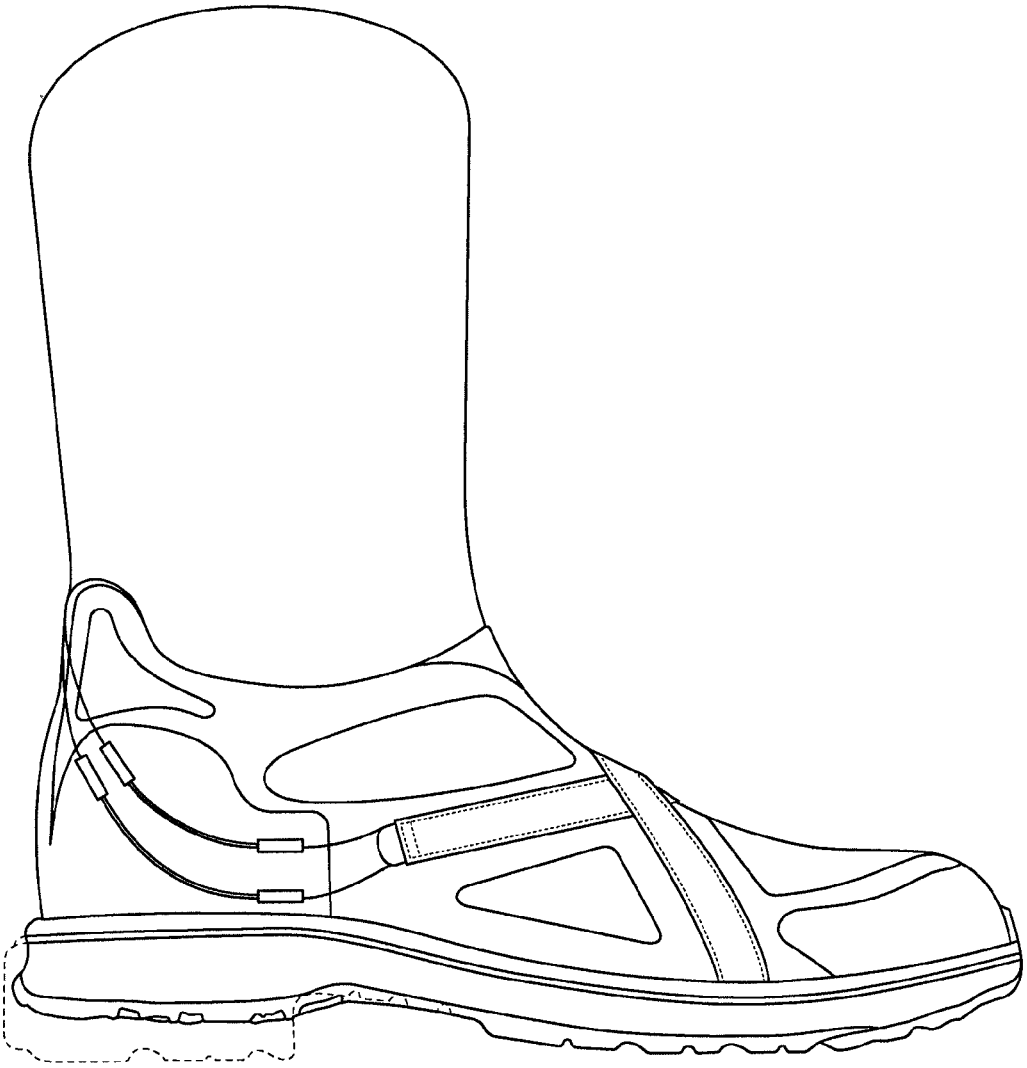
FIG. 10 is an isometric view of a first alternative embodiment of the footwear according to the present disclosure.

In a first alternative embodiment, the foot securing system is integrated into the exterior material of the footwear. The footwear depicted is a trail running type shoe. Referring to FIG. 10, the footwear is constructed such that when engaged, the outer shape of the footwear contracts against the user's foot. In addition, in the depicted embodiment the cable is exposed in that it is viewable from the exterior of the footwear. The tensioning mechanisms both in the heel and forefoot areas (e.g., instep hold down and heel retaining systems) are otherwise very similar to the mechanism described above.

Figure 11:
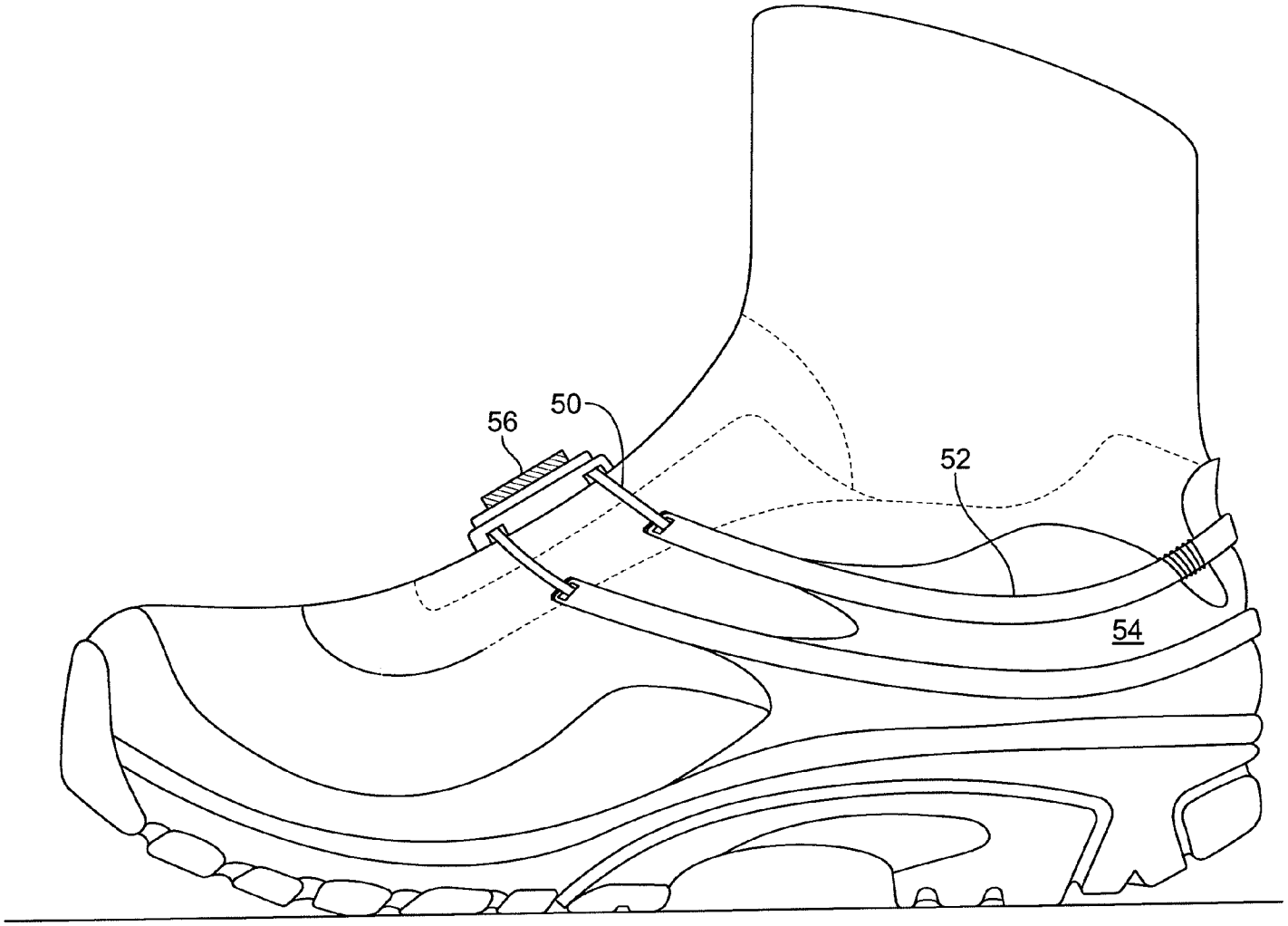
FIG. 11 is a side view a second alternative embodiment of the footwear according to the present disclosure.
Figure 12:
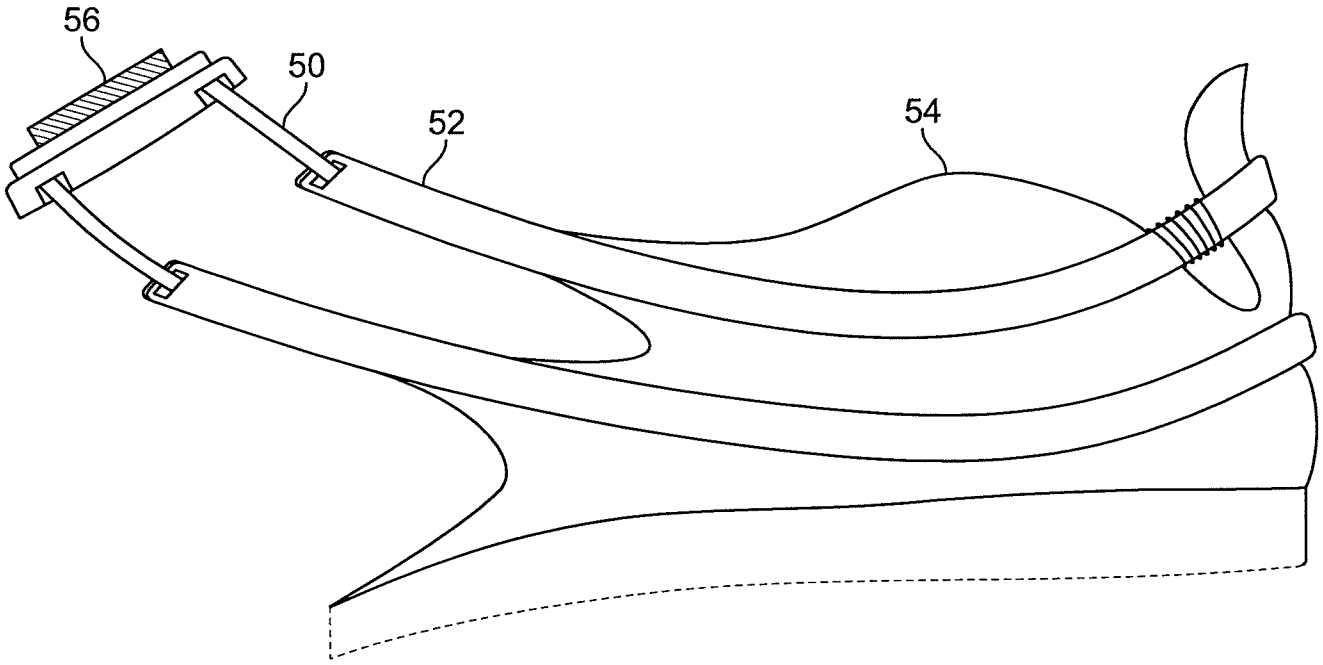
FIG. 12 is a side view of a portion of the footwear of FIG. 11.

In a second alternative embodiment, the foot securing system is also integrated into the exterior material of the footwear. Again the footwear depicted is a trail running type shoe. Referring to FIGS. 11 and 12, the footwear is constructed such that when engaged, the outer shape of the footwear contracts against the user's foot. In the depicted embodiment a portion of the cable 50 is exposed in that it is viewable from the exterior of the footwear. Other portions of the cable are positioned within conduits 52. The cable when tensioned actuates a heel counter component 54 that constricts against the user's heel when engaged as well as applies rearward and downward pressure on the user's instep. In the depicted embodiment the cable take up mechanism 56 is located above the forefoot portion of the footwear.

Referring back particularly to FIG. 8, the cable routing is described in greater detail. In the depicted embodiment the rotating mechanism for cable take up is located on the upper end of the outside surface of the neck portion 12 of the boot 10. Both ends of the cable terminate within the rotating mechanism, which is configured to take up (effectively shorten) the cable when the dial 16 is rotated clockwise. In the depicted embodiment, rotating the dial 16 clockwise causes both ends of the cable 30 to be pulled into the rotating mechanism a substantially equal amount. As the cable 30 is tensioned, it pulls downward and forwardly on the rear portion 24 of the heel counter 23, inwardly on the top portions of the first and second side portions of the heel counter 23, and rearward and downwardly on the first strap 32. The direction of force on the heel as well as the instep is controlled in part by the placement of the cable routing on the heel counter as well as the geometry of the heel counter 23 itself which, as discussed above, acts as a spring that biases the heel counter components outwardly, and the geometry of the free floating straps 32, 34 that are anchored along the ball girth GG and foot bed intersection.

As discussed above, a foot securing system of the depicted embodiment includes both an instep hold down system and a heel retaining system that are integrated to cooperatively secure the user's foot within the footwear. As discussed above, the single cable configuration provides load balancing which results in evenly distributed pressure on the foot from front to back and side to side. It should be appreciated, however, that in alternative embodiments the foot securing system may, as discussed above, only include an instep hold down system or only include a heel retaining system. Also, in alternative embodiments that do include both systems, the system could be independently tensioned to allow the user to apply more or less pressure to either one of the systems without adding pressure to the other system.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A boot comprising:

a flexible sole;

an upper connected to the sole, the upper including a foot receiving portion and a lower leg receiving portion connected above the foot receiving portion, the lower leg receiving portion including a portion without external tightening structures thereon;

a heel counter located in a rear portion of foot receiving portion including an inside portion, an outside portion, and a rear portion;

a foot securing system configured to move the inside portion of the heel counter towards the outside portion of the heel counter, and move the outside portion of the heel counter towards the inside portion of the heel counter; and a foot hold down strap including a first end and a second end, the first end being anchored to a forefoot portion of the foot receiving portion adjacent the flexible sole, wherein the foot securing system is configured to engage the second end of the strap and apply tension thereto in a rearward and downward direction.

2. The boot of claim 1, wherein the foot securing system is configured to move the rear portion of the heel counter in a forward direction.

3. The boot of claim 1, wherein the foot securing system is configured to simultaneously move the inside portion of the heel counter towards the outside portion of the heel counter.

4. The boot of claim 1, wherein the foot securing system includes a single tensioning cable that engages the inside portion as well as the outside portion of the heel counter.

5. The boot of claim 1, wherein the upper includes an outer covering that encloses the heel counter, and wherein the foot securing system includes a cable take up and release mechanism that extends through the outer covering and includes an exposed dial on the exterior of the boot.

6. The boot of claim 1, wherein a portion of the foot securing system includes a rotating cable take up and release mechanism and a tensioning cable, wherein at least a portion of the rotating cable take up and release mechanism and a portion of the tension cable are viewable from the exterior of the boot.

7. The boot of claim 1, wherein a tensioning cable is internal to the boot and engages both the inside portion and the outside portion of the heel counter.

8. The boot of claim 1, wherein the inside portion includes an upper portion and a lower portion, the outside portion includes an upper portion and a lower portion, and the rear portion includes an upper portion and a lower portion; wherein the upper portion of the inside portion, the upper portion of the outside portion, and the upper portion of the rear portions are separate from each other; and wherein the lower portion of the inside portion, the lower portion of the outside portion, and the lower portion of the rear portions are connected to each other.

9. The boot of claim 1, wherein the lower leg receiving portion is devoid of laces, buckles, or zippers.

10. The boot of claim 5, wherein the foot securing system includes a single cable that engages a first hold down strap and a second hold down strap to apply tension thereto and bias upper portions of the inside, outside, and rear portion of the heel counter inwardly.

11. The boot of claim 1, wherein the lower leg receiving includes a slip-on configuration.

12. A boot comprising:

a flexible sole;

an upper connected to the sole, the upper including a foot receiving portion and a lower leg receiving portion connected above the foot receiving portion, the lower leg receiving portion including a portion without external tightening structures thereon;

a heel counter located in a rear portion of foot receiving portion including an inside portion an outside portion and a rear portion;

a foot securing system configured to move the inside portion of the heel counter towards the outside portion of the heel counter, and move the outside portion of the heel counter towards the inside portion of the heel counter; and a first foot hold down strap and a second hold down strap, each of the first and second hold down straps including first ends anchored to a forefoot portion of the foot receiving portion adjacent the flexible sole, wherein the first and second straps overlap and are free to move relative to each other, wherein the tensioning system is configured to engage the second ends of the straps and apply tension thereto in a rearward and downward direction.

13. The boot of claim 12, wherein the foot securing system is configured to simultaneously apply tension to the first and second hold down straps.

14. The boot of claim 12, wherein the foot securing system is configured to simultaneously apply tension to the first and second hold down straps and move the inside portion of the heel counter towards the outside portion of the heel counter and move the rear portion of the heel counter in a forward direction.

15. A boot comprising:

a flexible sole;

an upper connected to the sole, the upper including a foot receiving portion and a lower leg receiving portion connected above the foot receiving portion, the lower leg receiving portion including a portion without external tightening structures thereon;

a heel counter located in a rear portion of the foot receiving portion including an inside portion, an outside portion, and a rear portion;

an instep hold down portion including a first strap and a second strap, wherein the first and second straps include first ends anchored in the forefoot portion, wherein the first and second straps overlap and cross a median line of the sole, wherein the first and second straps include second ends that extend rearward and downwardly; and a foot securing system including a rotating cable take up mechanism configured such that rotating the cable take up mechanism applies tension on the first and second straps.

16. The boot of claim 15, wherein the lower leg receiving portion includes includes a slip-on configuration.

17. The boot of claim 15, wherein the foot securing system includes a single cable that slidably engages the second ends of both straps and extends into the rotating cable take up mechanism.

18. The boot of claim 15, further comprising a heel counter located in a rear portion of the foot receiving portion including an inside portion, an outside portion, and a rear portion, wherein the foot securing system is configured to simultaneously apply tension to the first and second hold down straps and move the inside portion of the heel counter towards the outside portion of the heel counter and move the outside portion of the heel counter towards the inside portion of the heel counter.

* * * * *